US006032680A

United States Patent [19]

Lu et al.

[11] Patent Number: 6,032,680

[45] Date of Patent: Mar. 7, 2000

[54] HAIR CLIP RETAINER

[76] Inventors: Chee-Yin Lu, 7817 La Guardia Dr., Plano, Tex. 75025; James Bears, 8870 Cicero Dr., Boynton Beach, Fla. 33437

[21] Appl. No.: 09/295,031

[22] Filed: Apr. 20, 1999

[51] Int. Cl.[7] ..... A45D 8/00

[52] U.S. Cl. ..... 132/275; 132/273; 132/278

[58] Field of Search ..... 132/275, 273, 132/212, 200; 2/312, 314, 316, 317, 318, 319; 24/575, 576, 579.1, 16 PB, 17 AP, 370; D28/39, 40, 41

[56] References Cited

U.S. PATENT DOCUMENTS

| | | | |
|---|---|---|---|
| 2,805,673 | 9/1957 | Solomon | 132/275 |
| 3,000,384 | 9/1961 | Piers, Jr. | 132/273 |
| 3,842,849 | 10/1974 | Goodman . | |
| 4,481,681 | 11/1984 | Hankin | 2/197 |
| 4,501,049 | 2/1985 | Adamson | 24/16 PB |
| 5,020,749 | 6/1991 | Kraus | 24/16 PB |
| 5,115,825 | 5/1992 | Kuhn | 132/275 |
| 5,167,245 | 12/1992 | Harriett . | |
| 5,293,884 | 3/1994 | Chapman et al. . | |
| 5,577,698 | 11/1996 | Liu et al. | 24/16 PB |
| 5,797,408 | 8/1998 | Wilson | 132/275 |

*Primary Examiner*—Gene Mancene
*Assistant Examiner*—Pedro Philogene
*Attorney, Agent, or Firm*—David M. O'Dell

[57] ABSTRACT

An apparatus and method for retaining hair is disclosed. The apparatus includes a flexible member having a latching section and a band section. The band section includes a ridge portion and the latching section includes one or more teeth for selectively engaging with the ridge portion. The apparatus also includes a decorative sleeve for covering the band section. In operation, the band section can be wrapped around the group of hair and positioned with the latching section so that the one or more teeth engage with the ridge portion of the band section and thereby secure the band section into a loop around the hair.

18 Claims, 4 Drawing Sheets

10
20
22
24
24o
28
30
32
34
40
42
44

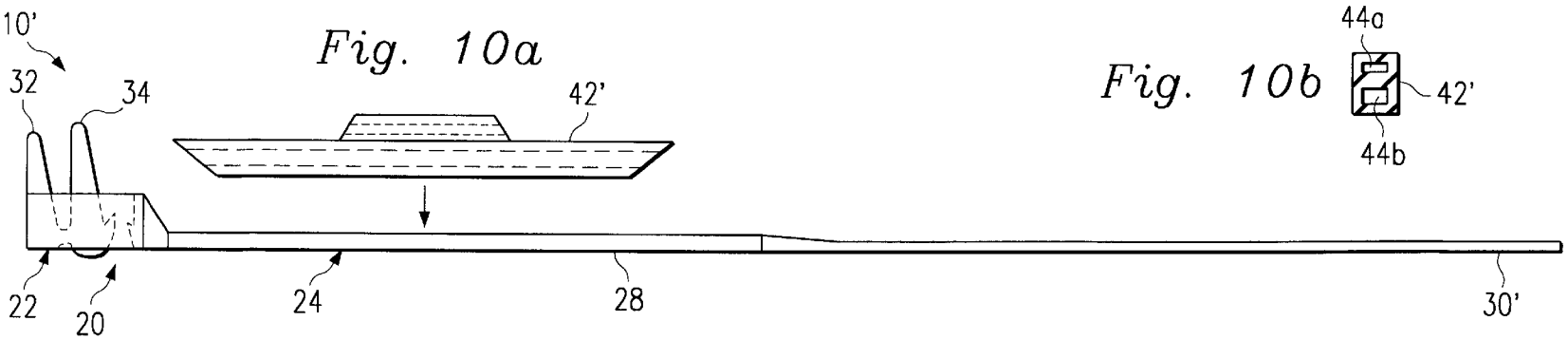
Fig. 10a
Fig. 10b
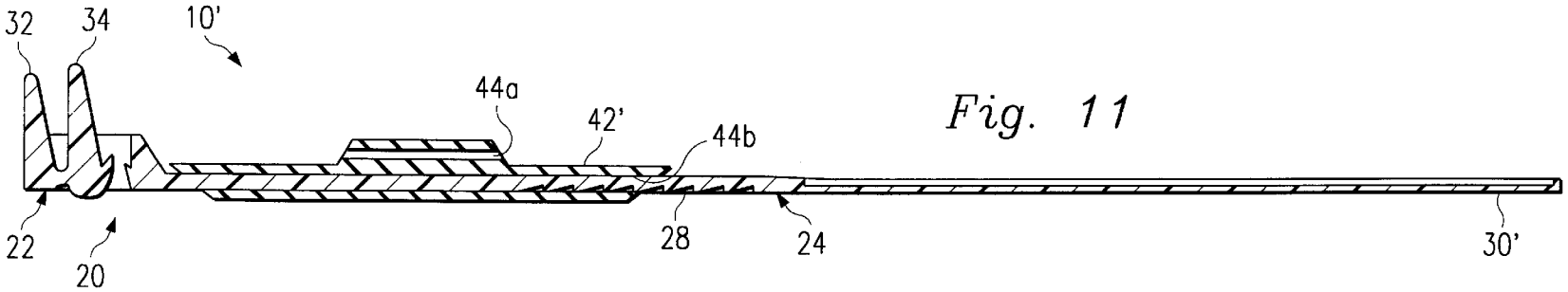
Fig. 11
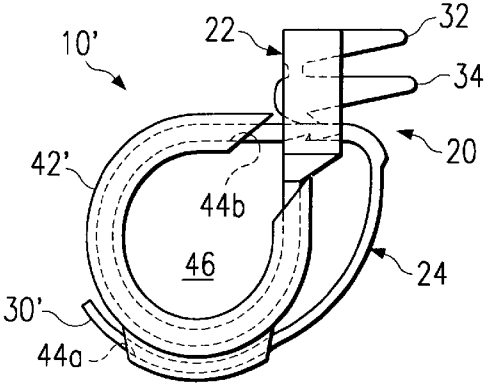
Fig. 12

HAIR CLIP RETAINER

TECHNICAL FIELD

This invention relates to an ornamental hair retainer such as can be used for forming a pony tail.

BACKGROUND OF THE INVENTION

A popular hair style for men and women involves grouping and retaining a portion of their hair into one or more "pony tails." A pony tail is simply a group of hair gathered and held together by some type of retainer. By and large, the most common type of retainer is a rubber band. Other types of retainers include hair clips, ribbon, and bows.

Each of these types of retainers have different benefits. A rubber band is inexpensive and holds the hair together well. However, a rubber band is not ornate and is difficult to put on. The difficulty of arranging hair with a rubber band is often accentuated with young girls with a low tolerance for having their hair pulled.

Hair clips can be ornate and relatively simple to use, but are limited to retaining a predetermined amount of hair. Ribbons and bows are also ornate, and can accommodate different amounts of hair. However, ribbons and bows are difficult to use and easily fall out.

Therefore, what is needed is a hair retainer system that is ornamental, easy to use, and can accommodate different amounts of hair.

SUMMARY OF THE INVENTION

Provided herein is a new and unique apparatus and method for retaining hair. In one embodiment, the apparatus includes a flexible member having a latching section and a band section. The band section includes a ridge portion and the latching section includes one or more teeth for selectively engaging with the ridge portion. In operation, the band section can be wrapped around the group of hair and positioned with the latching section so that the one or more teeth engage with the ridge portion of the band section and thereby secure the band section into a loop around the hair.

In some embodiments, the apparatus may also include a decorative sleeve for covering the band section. The decorative sleeve may be made of a compressible material so that it will compress when it is pulled tightly around the hair. The compressed sleeve moves with the hair while maintaining a frictional force to help the band section grip the hair.

In another embodiment, the flexible band section including a portion for selectively engaging with a latching member. The selective engagement may be by friction or other means. As a result, the band section forms a loop around the group of hair when engaged.

BRIEF DESCRIPTION OF THE DRAWINGS

FIGS. 10*a*, 10*b* and 11 show the flexible member of FIG. 9 having a decorative sleeve.

FIG. 12 shows the hair retainer of FIG. 11 being configured for operation.

DESCRIPTION OF A PREFERRED EMBODIMENT

Figure 1:
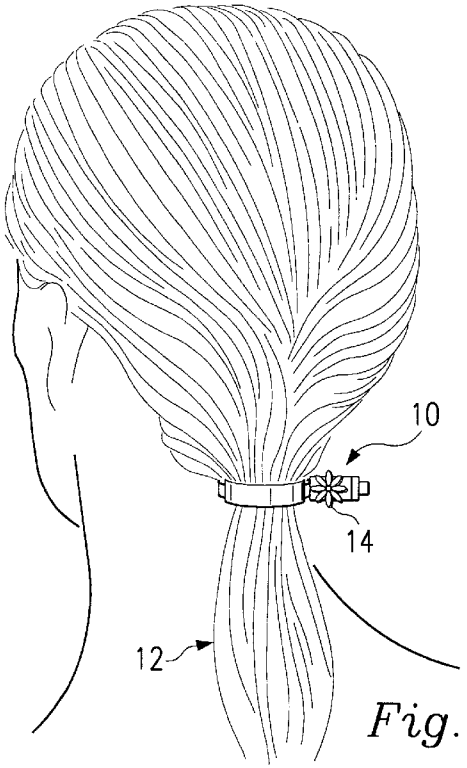
FIG. 1 provides a back-view of a person's head of hair arranged in a pony tail by one embodiment of a hair retainer implementing features of the present invention.

Referring to FIG. 1, the reference numeral 10 designates, in general, one embodiment of a hair retainer implementing features of the present invention. The hair retainer 10 is shown holding a portion of hair 12 into a pony tail configuration. The hair retainer 10 includes an ornament 14, which in the present example is a flower. It is understood, however, that different ornaments may be used, such as jewelry, beads, ribbons, and the like.

Figure 3:
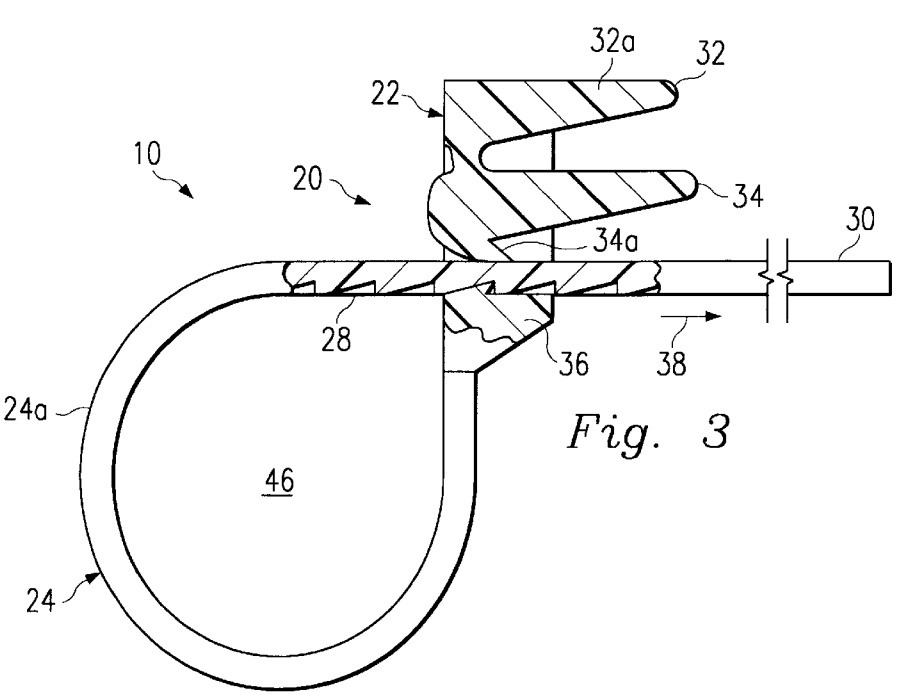
FIG. 3 illustrates how the flexible member of FIG. 2 can be engaged for retaining a gathered amount of hair.
Figure 2:
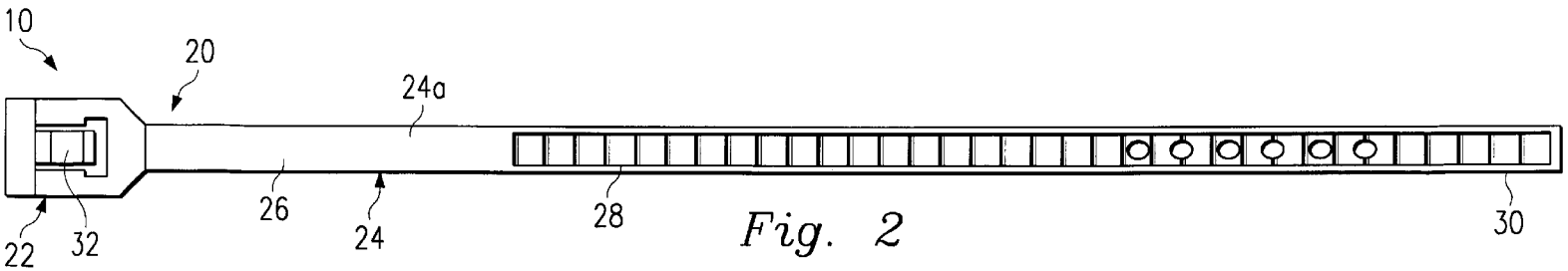
FIG. 2 illustrates one embodiment of a flexible member used by the hair retainer of FIG. 1.

Referring to FIGS. 2 and 3, the hair retainer 10 is formed around a flexible member 20. The flexible member 20 includes a latching section 22 and a band section 24. In the present example, the flexible member 20 is formed from a single, monolithic plastic mold. It is understood that many different configurations of the latching and band sections 22, 24 may be used, but for the sake of example, the band section is relatively long and flat and the latching section is shaped to accommodate the flat band section.

The band section 24 includes a smooth portion 26, a ridged portion 28, and a feeder portion 30. In some embodiments, the band section may consist entirely of the ridged portion 28. The ridge portion includes a plurality of teeth, or ridges, on one or both sides of the band section 24. In the present example, the ridges are only formed on a side 24*a* of the band section.

The latching section 22 includes two tabs 32, 34. The first tab 32 includes a surface 32*a* for supporting ornaments such as the ornament 14 of FIG. 1. The second tab 34 includes one or more teeth 34*a* for selectively engaging with the ridged portion 28 of the band section 24. The latching section 22 also includes a staying member 36. The staying member 36 and second tab 34 are spaced so that the distance there between can easily receive the band section 24.

Referring specifically to FIG. 3, when the band section 24 is placed in the latching section 22, the teeth 34*a* engage with the ridge portion 28. When the band section 24 is moving in a direction indicated by arrow 38 (the tightening direction), the ridge portion 28 moves freely pass the teeth 34*a*. However, the engagement between the teeth 34*a* and the ridge portion 28 prevents movement of the band section 24 in a direction opposite to arrow 38 (the loosening direction). Instead, to loosen the band section, a user must press the second tab 34 towards the first tab 32, thereby releasing the engagement between the teeth 34*a* and the ridged section 28.

Figures 4A, 4B, 5:
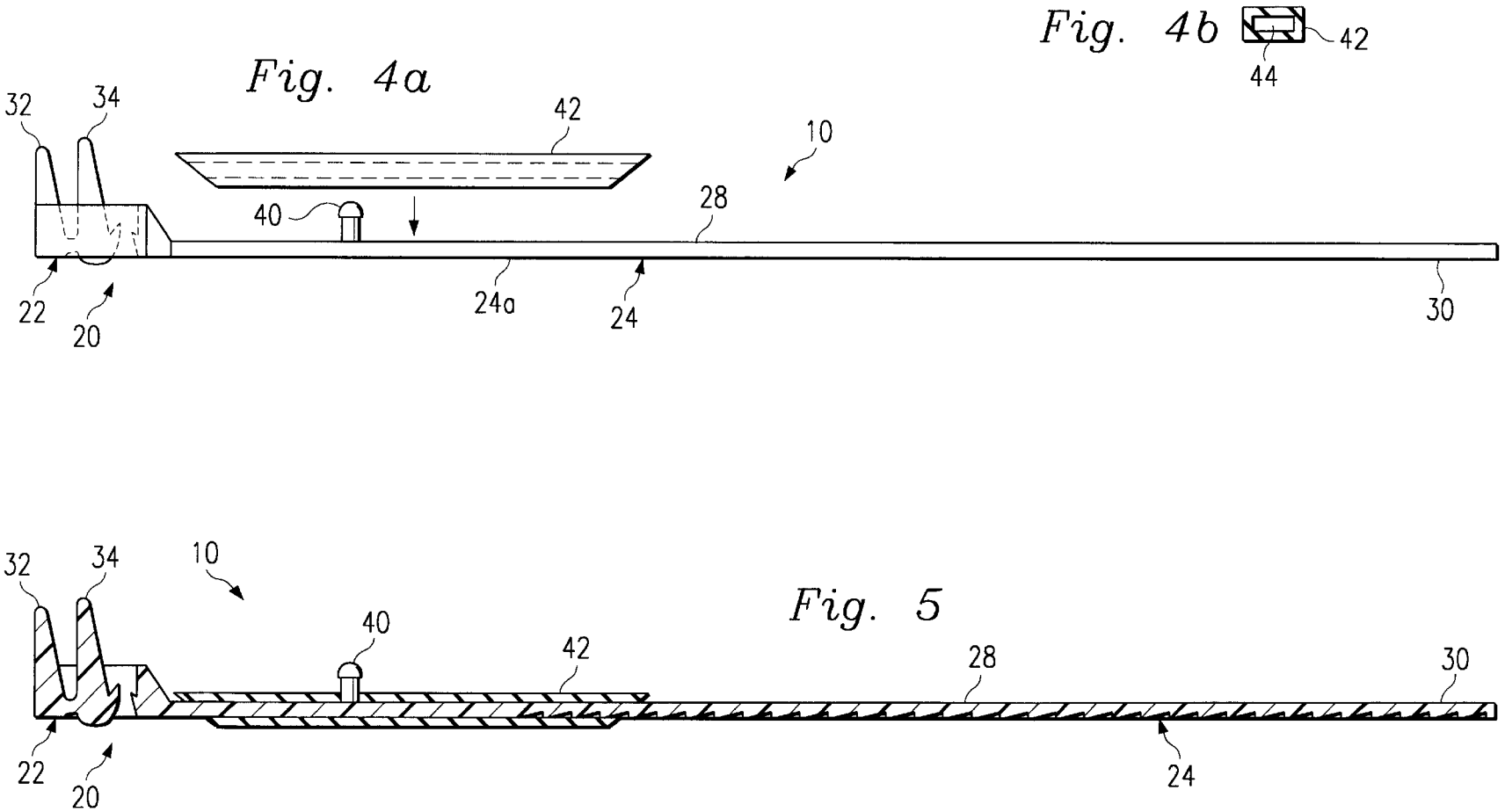
FIGS. 4*a*, 4*b* and 5 show the flexible member of FIG. 2 having a decorative sleeve.

Referring to FIGS. 4*a*, 4*b*, and 5, in some embodiments, the flexible member 20 includes a protrusion 40 on the surface 24*a* of the band section 24. In this way, the flexible member 20 can receive and secure a decorative sleeve 42. In the present embodiment, the decorative sleeve 42 is made of a flexible material, such as cloth. The decorative sleeve is also interchangeable, and can thereby be selected from a group of sleeves (not shown) for color and other properties. The decorative sleeve 42, having a slot 44, can be slid onto the band section 24. When the decorative sleeve 42 is in a desired location, the protrusion 40 aligns with and extends through a hole in the sleeve (not shown).

Figure 6:
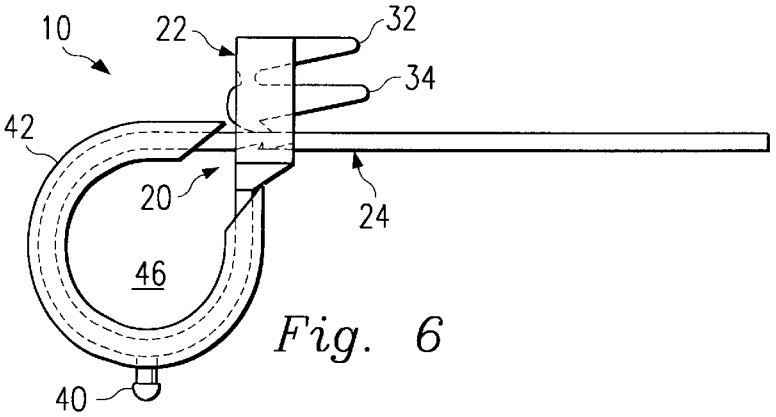

Referring to FIG. 6, when the decorative sleeve 42 is in place on the band section 24 (FIG. 5), and when the band section 24 is engaged with the latching section 22 (FIG. 3), a loop 46 is formed. The decorative sleeve covers at least a portion of the smooth portion 26 of the band section 24. It is understood, however, that different amounts of the band section 24 can be positioned through the latching section 22 to accommodate different sized loops 46 (and hence different amounts of hair). Accordingly, the decorative sleeve 24 may, in some configurations, only cover a small portion of the smooth section 26, and in other configurations, the sleeve is gathered against the latching section 22 as the band section is tightened.

In some embodiments, the portion of the band section 24 that is covered by the decorative sleeve 42 may be made of a stretchable material. In these embodiments, the stretchable portion would help to maintain tension on the hair 12.

The decorative sleeve 42 may, in some embodiments, be made of a compressible material such as latex rubber. The compressible material will compress when the band section 24 is tightened in the latching section 22. The compression of the decorative sleeve 42 flexibly engages with the hair 12 so that when the hair shifts or moves, the decorative sleeve maintains a significant amount of pressure pressing onto the hair.

The flexible/compressible nature of the sleeve 42 is contrasted with the relatively inelastic nature (in some embodiments) of the band section 24. The band section 24 is flexible but not very stretchable, thereby facilitating latching and maintaining product reliability. The combined effects of a good grip due to a high friction surface on the sleeve 42 and high pressure maintained by the compressible material of the sleeve and the latched band section 24 serve to grip well to the hair 12 despite any random movements such as during walking or when assembling the retainer 10 to the hair. It is understood that a relatively non-compressible band section 24 will not grip well to the hair 12, as compared to the compressible decorative sleeve 42.

As described above, in some embodiments, the sleeve 42 is a separate component of the retainer 10. In other embodiments, at least a portion of the sleeve 42 is manufactured onto the band section 24. In these latter embodiments, the portion that is manufactured onto the band section 24 may only include the part of the sleeve that is adjacent to the hair 12. In this way, the ability to grip the hair 12 is included with the band section 24 without a separate sleeve 42.

Figure 7:
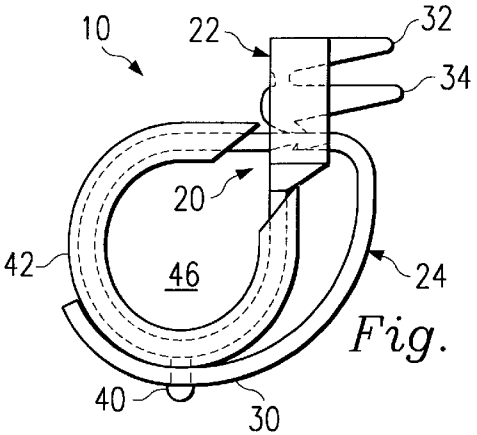
FIGS. 6, 7, and 8 show the hair retainer of FIG. 5 being configured for operation.

Referring to FIG. 7, the feeder portion 30 of the band section 24 may include a plurality of holes (such as is illustrated in FIG. 2). One or more of the holes may be engaged with the protrusion 40 to secure the feeder portion in a stable position so that it does not stick out and be visually or physically undesirable. Alternatively, the feeder portion may be tucked inside the hair (FIG. 1) or may be cut off.

Figure 8:
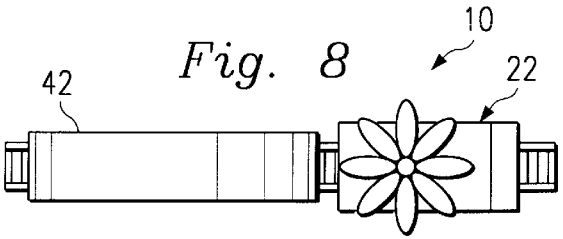

Referring to FIG. 8 and again to FIG. 1, in operation, the hair 12 is gathered, such as by hand or a comb and the band section 24 (with the decorative sleeve 42) is wrapped around the gathered hair to form the loop 46. The band section is then fed through the latching section 22 and the feeder portion 30 is engaged to the protrusion 40. The feeder portion 30 and protrusion 40 are relatively hidden against the persons head (as shown in FIG. 1).

Figure 9:
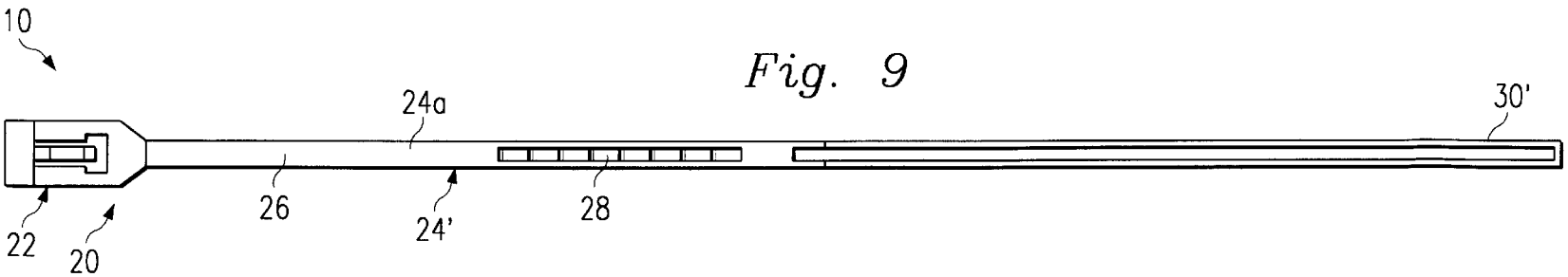
FIG. 9 illustrates another embodiment of a flexible member used by the hair retainer of FIG. 1.

FIG. 9 illustrates an alternate embodiment of the hair retainer 10, hereinafter designated as the hair retainer 10'. The hair retainer 10' includes many of the same components as the hair retainer 10, such components being consistently numbered. The hair retainer 10' includes a flexible member 20' The flexible member 20' includes the latching section 22 and a relatively thin band section 24'. The band section 24' includes the smooth portion 26, the ridged portion 28, and a thin feeder portion 30'. The feeder portion 30' may in addition include a long slot which further reduces its thickness. The slot also increases the flexibility of the feeder portion 30' and may be visually attractive, such as if it were a pair of dangling strings on which decorations may be hung.

Referring to FIGS. 10*a*, 10*b*, and 11, in the present embodiments, the flexible member 20' does not include any protrusions. Instead, a decorative sleeve 42' includes two slots 44*a*, 44*b*. The decorative sleeve 42' is slid onto the band section 24' using the first slot 44*a* and the second slot 44*b* is used as described below.

Referring to FIG. 12, when the decorative sleeve 42' is in place on the band section 24 (FIG. 11), and when the band section 24 is engaged with the latching section 22 (FIG. 3), the decorative sleeve covers at least a portion of the smooth portion 26 of the band section 24'. Furthermore, the second aperture 44*a* can receive the thin feeder portion 30'. Therefore, in operation, the hair retainer 10' works similarly to the hair retainer 10 of FIG. 8.

Although illustrative embodiments have been shown and described, other modifications, changes, and substitutions are intended in the foregoing disclosure. For example, instead of using ridges 28 and teeth 34*a*, the flexible member 20 can use other arrangements to secure the band section 24 to the latching section 22. Accordingly, it is appropriate that the appended claims be construed broadly and in a manner consistent with the scope of the disclosure.

What is claimed is:

1. An apparatus for retaining a group of hair comprising:

a flexible member having a latching section and a band section, wherein the band section includes a ridge portion and a separated securing portion, and the latching section includes one or more teeth for selectively engaging with the ridge portion; and a decorative sleeve for covering the securing portion of the band section;

wherein the band section can be wrapped around the group of hair and positioned with the latching section so that the one or more teeth engage with the ridge portion of the band section and thereby secure the band section into a loop around the hair, and wherein the securing portion is secured away from the latching section.

2. The apparatus of claim 1 wherein the decorative sleeve is made of an elastically compressible material for gripping with the group of hair.

3. The apparatus of claim 1 further comprising:

an ornament affixed to the latching section.

4. The apparatus of claim 1 wherein the securing portion includes a protrusion portion and an aperture portion, the protrusion portion for engaging with the decorative sleeve and for securing the aperture portion of the band section when the band section is formed into the loop, so that when the aperture portion and protrusion portion are engaged, they are physically separated from the latching section.

5. The apparatus of claim 4 wherein the the securing portion can be pulled for tightening the band section in the latching section.

6. The apparatus of claim 1 wherein the band section further includes a feeder portion having a relatively long slot so as to give an appearance that the feeder portion is a dangling string.

7. The apparatus of claim 1 wherein the decorative sleeve includes a slot so that when the band section is formed into the loop, a portion of the band section can be inserted into and thereby secured by the slot.

8. A method for retaining a group of hair comprising:

placing a decorative sleeve around a flexible band section, the decorative sleeve including an elastically compressible portion for gripping with the group of hair;

wrapping the flexible band section around the group of hair, the flexible section connected to a latching member and including a feeder portion, a securing portion, and a latching portion with one or more ridges;

inserting the feeder portion and latching portion of the flexible band into the latching member;

engaging the latching member with the one or more ridges of the latching portion so that the feeder portion extends past the latching member, and engaging the feeder portion with the securing portion;

whereby, when engaged, the band section forms a secure loop around the group of hair.

9. The method of claim 8 further comprising:

selecting the decorative sleeve from a group of sleeves.

10. The method of claim 8 further comprising:

affixing an ornament to the latching section.

11. The method of claim 8 wherein the feeder portion includes an aperture and the securing portion includes a protuberance, whereby the step of engaging the feeder portion includes inserting the protuberance into the aperture.

12. The method of claim 8 wherein the securing portion is created by forming a slot with the decorative sleeve, and whereby the step of engaging the feeder portion includes inserting the feeder portion into the slot on the decorative sleeve.

13. A system for retaining a group of hair comprising:

a latching member;

a flexible band section being capable of wrapping around the group of hair, the flexible section including a feeder portion for feeding through the latching member and a latching portion for selectively engaging with the latching member; and a securing means for receiving and engaging with the feeder portion of the flexible band section, the securing means being physically separated from the latching member so that when the latching member is exposed, the securing means is hidden by the group of hair;

whereby, when engaged, the band section forms a fixed loop around the group of hair.

14. The system of claim 13 further comprising:

a decorative sleeve for placement on the flexible band section.

15. The system of claim 13 further comprising:

an ornament holder attached to the latching section for receiving an ornament, wherein the ornament holder and ornament effectively hide the latching section.

16. The system of claim 13 wherein the securing means includes a protuberance on the flexible band for selectively engaging with the feeder portion.

17. The system of claim 14 wherein the securing means includes a slot on the decorative sleeve for selectively engaging with the feeder portion.

18. The system of claim 13 wherein the band section includes a stretching portion for forming the fixed loop.

* * * * *